US011029036B2

(12) United States Patent
Farrel

(10) Patent No.: US 11,029,036 B2
(45) Date of Patent: Jun. 8, 2021

(54) INTERLOCKING DOOR FRAME ASSEMBLY FOR AN APPLIANCE

(71) Applicant: Haier US Appliance Solutions, Inc., Wilmington, DE (US)

(72) Inventor: Caleb Farrel, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 49 days.

(21) Appl. No.: 16/531,225

(22) Filed: Aug. 5, 2019

(65) Prior Publication Data

US 2021/0041109 A1 Feb. 11, 2021

(51) Int. Cl.
*F24C 15/04* (2006.01)
*F24C 15/02* (2006.01)

(52) U.S. Cl.
CPC ..... *F24C 15/04* (2013.01); *F24C 15/023* (2013.01)

(58) Field of Classification Search
CPC ..... F24C 15/04; F24C 15/102; A47F 3/0434; B60J 5/0434; B60J 5/0413; B60J 5/0416; B60J 5/0418; B60J 5/0429; B60J 5/043; A47B 2013/025; A47B 2095/004; A47B 2200/001; A47B 2200/0021; A47B 2230/0014; A47B 57/58; A47B 5/00; A47B 7/00; A47B 91/005; A47B 95/002; A47B 95/008; A47B 96/067; A47B 96/07; A47B 47/02; A47B 61/00; A47B 61/003; A47C 17/50; A47C 5/12; A47C 7/004; A47C 10/02; A47C 1/12; A47C 2010/025; A47C 5/0025; A47C 5/005; A47L 9/0411; A47L 9/0455; A47L 9/0477; A47L 9/0673; F25D 23/028; F25D 2323/024; F25D 23/00; F25D 23/02; F25D 23/025; F25D 23/04; F25D 23/085; F25D 23/087; F25D 25/027; F25D 17/04; F25D 2323/021; F25D 23/006; E05B 65/0042; E05B 13/002; E05B 15/0093; E05B 65/025; E05B 9/08; E05B 13/10; E05B 1/0015; E05B 67/383; E05B 15/02;

(Continued)

(56) References Cited

U.S. PATENT DOCUMENTS 3,845,604 A * 11/1974 Ottosson ..... E06B 3/984 52/204.597
5,887,629 A * 3/1999 Mettler ..... D03C 9/0675 139/91

(Continued)

FOREIGN PATENT DOCUMENTS

CN 204531927 U 8/2015
GB 2250531 B 6/1992

*Primary Examiner* — Jason Lau
(74) *Attorney, Agent, or Firm* — Dority & Manning, P.A.

(57) ABSTRACT

A door assembly for providing selective access to a chamber of an appliance includes a plurality of frame members that are joined quickly and easily using a plurality of interlocking joints. Specifically, a first frame member defines an alignment recess that is defined at least in part by a front locating surface and is configured for receiving a locking protrusion defined on a second frame member. A mechanical fastener urges the second frame member toward the first frame member such that a front seating face of the locking protrusion engages the front locating surface, thereby aligning a front and/or side of the second frame member such that it is flush with the first frame member.

19 Claims, 10 Drawing Sheets

(58) Field of Classification Search
CPC ..... E05B 1/0092; E05B 59/00; E05B 63/22; E05B 65/02; E05B 81/06; E05B 13/005; E05B 13/105; E05B 15/00; E05B 15/0053; E05B 15/0205; E05B 15/10; E05B 15/102; E05B 15/1614; E05B 17/0025; E05B 17/0045; E05B 17/0058; E05B 17/04; E05B 17/042; E05B 17/047; E05B 17/049; E05B 17/2057; E05B 17/2084; E05B 1/003; E05B 1/0038; E05B 1/0053; E05B 2015/0066; E05B 2015/0496; E05B 2015/1628; E05B 2047/0048; E05B 2047/0056; E05B 2047/0067; E05B 2047/0068; E05B 2047/0072; E05B 2047/0086; E05B 3/00; E05B 3/06; E05B 3/065; E05B 47/00; E05B 47/0001; E05B 47/0002; E05B 47/0006; E05B 47/0012; E05B 47/0038; E05B 47/02; E05B 47/026; E05B 47/06; E05B 47/0607; E05B 49/00; E05B 55/00; E05B 55/12; E05B 63/0056; E05B 63/042; E05B 63/08; E05B 63/122; E05B 63/16; E05B 63/20; E05B 65/08; E05B 65/10; E05B 65/104; E05B 71/14; E05B 81/15; E05B 81/40; E05B 83/16; E05B 83/34; E05B 85/02; E05B 85/26; E05B 9/02; E05B 9/084; D06F 2103/50; D06F 2105/26; D06F 33/00; D06F 37/10; D06F 37/266; D06F 39/02; D06F 39/12; D06F 39/125; D06F 39/14; D06F 58/02; D06F 58/206; D06F 58/30
See application file for complete search history.

(56) References Cited

U.S. PATENT DOCUMENTS

| | | | |
|---|---|---|---|
| 6,561,180 | B1 | 5/2003 | Austin et al. |
| 8,413,649 | B2 | 4/2013 | Capacci |
| 2006/0027230 | A1 | 2/2006 | Jung |
| 2019/0219271 | A1* | 7/2019 | Bianchi ..... F24C 15/16 |

* cited by examiner

INTERLOCKING DOOR FRAME ASSEMBLY FOR AN APPLIANCE

FIELD OF THE INVENTION

The present subject matter relates generally to door assemblies for appliances, and more particularly, to interlocking door frame assemblies for an oven appliance.

BACKGROUND OF THE INVENTION

Conventional residential and commercial oven appliances generally include a cabinet that includes a cooking chamber for receipt of food items for cooking. Multiple heating elements are positioned within the cooking chamber to provide heat to food items located therein. The heating elements can include, for example, radiant heating elements, such as a bake heating assembly positioned at a bottom of the cooking chamber and/or a separate broiler heating assembly positioned at a top of the cooking chamber.

Conventional oven appliances further include a door that is pivotally mounted over an opening of the cooking chamber, e.g., to insulate and provide selective access to the cooking chamber. In order to permit viewing of food items during cooking, oven doors typically have a number of glass window panes mounted within a frame. Traditionally, door assemblies required complex assembly fixtures to align the outer door glass properly and utilize some form of adhesive to hold the glass in place. Other alternatives consist of additional bracketry to clamp the glass and are not typically easy to install together. As a result, safely securing such window panes within a window frame is typically a costly process that requires many components and long assembly times. In addition, existing assembly processes are not capable of quickly and simply obtaining a flush appearance to the front of the door while accounting for manufacturing variances and tolerances.

Accordingly, an improved door assembly for an appliance would be useful. More particularly, an interlocking door frame assembly that enables simplified assembly with fewer components would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a door assembly for providing selective access to a chamber of an appliance is provided. The door assembly includes a first frame member defining an alignment recess, the alignment recess defined at least in part by a locating surface. A second frame member defines a locking protrusion having a seating face, the locking protrusion being configured for receipt within the alignment recess. A mechanical fastener engages the second frame member to urge the seating face of the second frame member into engagement with the locating surface of the first frame member.

In a second example embodiment, an oven appliance defining a vertical, a lateral, and a transverse direction is provided. The oven appliance includes a cabinet, a cooking chamber positioned within the cabinet, and a door assembly rotatably mounted to the cabinet for providing selective access to the cooking chamber. The door assembly includes a first frame member defining an alignment recess, the alignment recess defined at least in part by a locating surface. A second frame member defines a locking protrusion having a seating face, the locking protrusion being configured for receipt within the alignment recess. A mechanical fastener engages the second frame member to urge the seating face of the second frame member into engagement with the locating surface of the first frame member.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
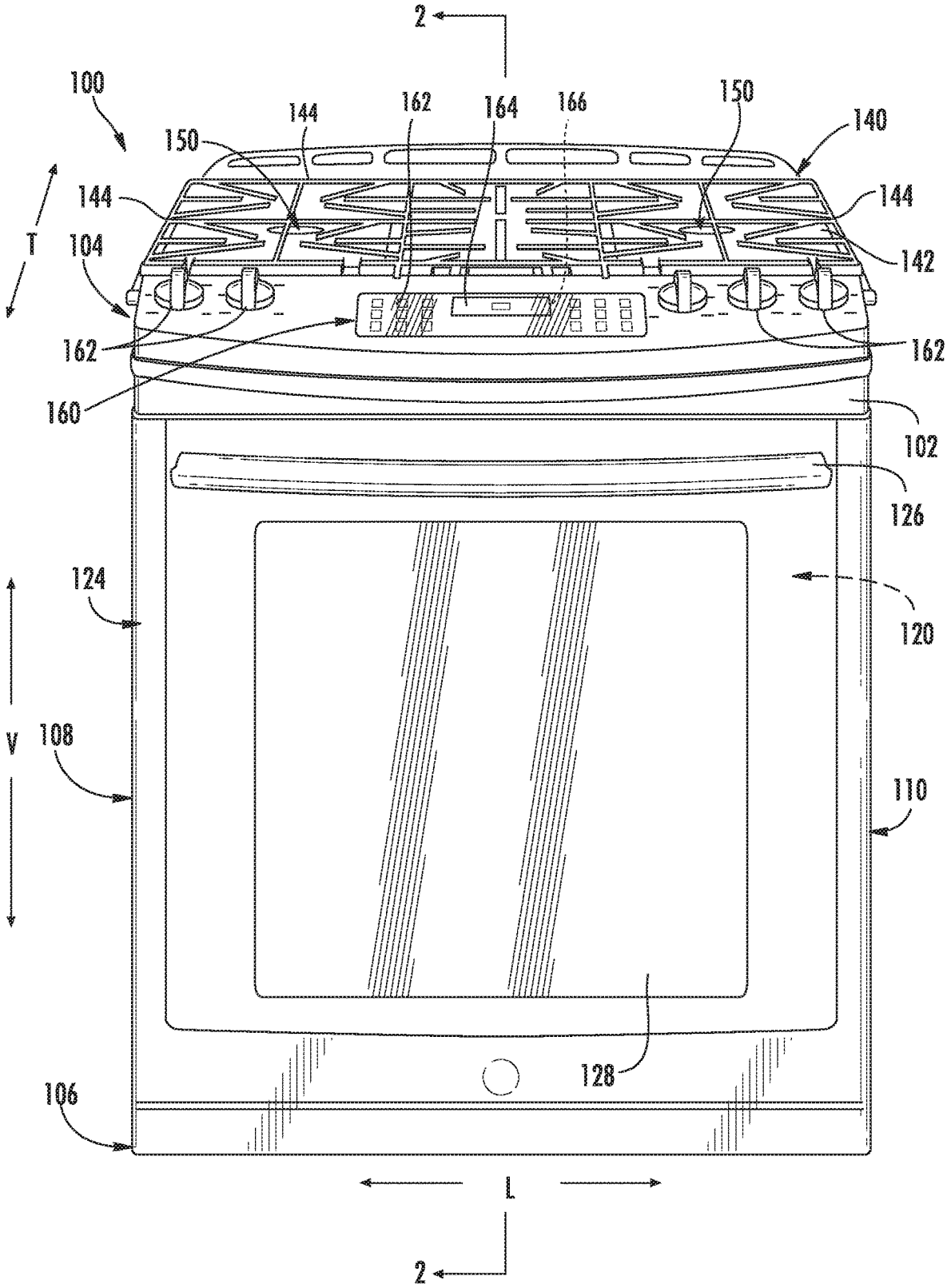
FIG. 1 is a front, perspective view of an oven appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, perspective view of an oven appliance 100 as may be employed with the present subject matter. Oven appliance 100 generally defines a vertical direction V, a lateral direction L, and a transverse direction T, each of which is mutually perpendicular, such that an orthogonal coordinate system is generally defined. As illustrated, oven appliance 100 includes an insulated cabinet 102. Cabinet 102 of oven appliance 100 extends between a top 104 and a bottom 106 along the vertical direction V, between a first side 108 (left side when viewed from front) and a second side 110 (right side when viewed from front) along the lateral direction L, and between a front 112 and a rear 114 along the transverse direction T.

Within cabinet 102 is a single cooking chamber 120 which is configured for the receipt of one or more food items to be cooked. However, it should be appreciated that oven appliance 100 is provided by way of example only, and aspects of the present subject matter may be used in any suitable cooking appliance, such as a double oven range appliance. Thus, the example embodiment shown in FIG. 1 is not intended to limit the present subject matter to any particular cooking chamber configuration or arrangement. Indeed, aspects of the present subject matter may be applied to door assemblies for any suitable appliance.

Oven appliance 100 includes a door 124 rotatably attached to cabinet 102 in order to permit selective access to cooking chamber 120. Handle 126 is mounted to door 124 to assist a user with opening and closing door 124 in order to access cooking chamber 120. As an example, a user can pull on handle 126 mounted to door 124 to open or close door 124 and access cooking chamber 120. One or more transparent viewing windows 128 (FIG. 1) may be defined within door 124 to provide for viewing the contents of cooking chamber 120 when door 124 is closed and also assist with insulating cooking chamber 120.

Figure 2:
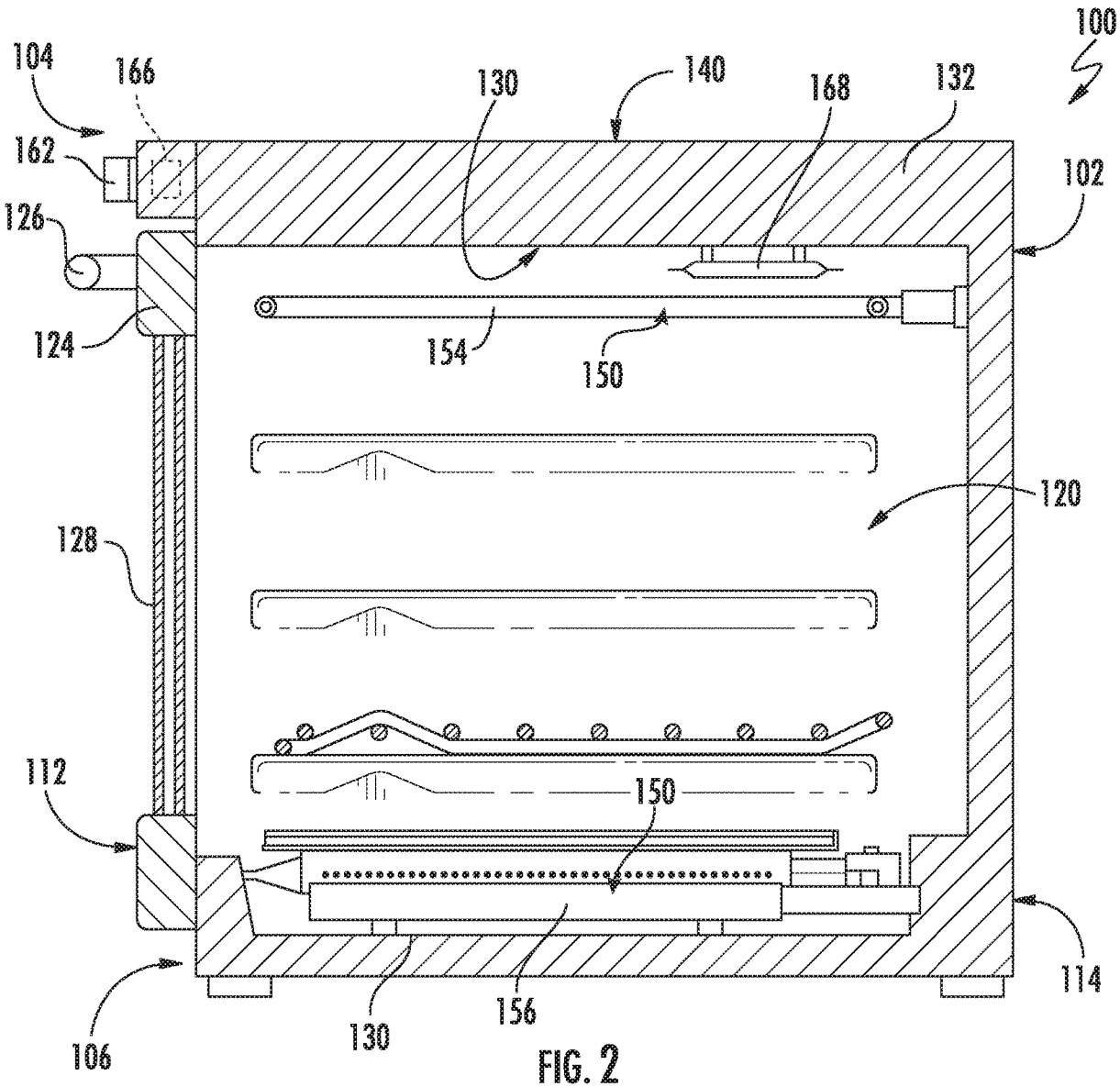
FIG. 2 is a schematic, cross sectional view of the exemplary oven appliance of FIG. 1, taken along Line 2-2 in FIG. 1.

In general, cooking chamber 120 is defined by a plurality of chamber walls 130 (FIG. 2). Specifically, cooking chamber 120 may be defined by a top wall, a rear wall, a bottom wall, and two sidewalls 130. These chamber walls 130 may be joined together to define an opening through which a user may selectively access cooking chamber 120 by opening door 124. In order to insulate cooking chamber 120, oven appliance 100 includes an insulating gap defined between the chamber walls 130 and cabinet 102. According to an exemplary embodiment, the insulation gap is filled with an insulating material 132, such as insulating foam or fiberglass, for insulating cooking chamber 120.

Oven appliance 100 also includes a cooktop 140. Cooktop 140 is positioned at or adjacent top 104 of cabinet 102 such that it is positioned above cooking chamber 120. Specifically, cooktop 140 includes a top panel 142 positioned proximate top 104 of cabinet 102. By way of example, top panel 142 may be constructed of glass, ceramics, enameled steel, and combinations thereof. One or more grates 144 are supported on a top surface of top panel 142 for supporting cooking utensils, such as pots or pans, during a cooking process.

Oven appliance 100 may further include one or more heating elements (identified generally by reference numeral 150) for selectively heating cooking utensils positioned on grates 144 or food items positioned within cooking chamber 120. For example, referring to FIG. 1, heating elements 150 may be gas burners 150. Specifically, a plurality of gas burners 150 are mounted within or on top of top panel 142 such that grates 144 support cooking utensils over gas burners 150 while gas burners 150 provide thermal energy to cooking utensils positioned thereon, e.g., to heat food and/or cooking liquids (e.g., oil, water, etc.). Gas burners 150 can be configured in various sizes so as to provide e.g., for the receipt of cooking utensils (i.e., pots, pans, etc.) of various sizes and configurations and to provide different heat inputs for such cooking utensils. According to alternative embodiments, oven appliance 100 may have other cooktop configurations or burner elements.

In addition, heating elements 150 may be positioned within or may otherwise be in thermal communication with cooking chamber 120 for regulating the temperature within cooking chamber 120. Specifically, an upper gas heating element 154 (also referred to as a broil heating element or gas burner) may be positioned in cabinet 102, e.g., at a top portion of cooking chamber 120, and a lower gas heating element 156 (also referred to as a bake heating element or gas burner) may be positioned at a bottom portion of cooking chamber 120. Upper gas heating element 154 and lower gas heating element 156 may be used independently or simultaneously to heat cooking chamber 120, perform a baking or broil operation, perform a cleaning cycle, etc. The size and heat output of gas heating elements 154, 156 can be selected based on the, e.g., the size of oven appliance 100 or the desired heat output. Oven appliance 100 may include any other suitable number, type, and configuration of heating elements 150 within cabinet 102 and/or on cooktop 140. For example, oven appliance 100 may further include electric heating elements, induction heating elements, or any other suitable heat generating device.

A user interface panel 160 is located within convenient reach of a user of the oven appliance 100. For this example embodiment, user interface panel 160 includes knobs 162 that are each associated with one of heating elements 150. In this manner, knobs 162 allow the user to activate each heating element 150 and determine the amount of heat input provided by each heating element 150 to a cooking food items within cooking chamber 120 or on cooktop 140. Although shown with knobs 162, it should be understood that knobs 162 and the configuration of oven appliance 100 shown in FIG. 1 is provided by way of example only. More specifically, user interface panel 160 may include various input components, such as one or more of a variety of touch-type controls, electrical, mechanical or electro-mechanical input devices including rotary dials, push buttons, and touch pads. User interface panel 160 may also be provided with one or more graphical display devices or display components 164, such as a digital or analog display device designed to provide operational feedback or other information to the user such as e.g., whether a particular heating element 150 is activated and/or the rate at which the heating element 150 is set.

Generally, oven appliance 100 may include a controller 166 in operative communication with user interface panel 160. User interface panel 160 of oven appliance 100 may be in communication with controller 166 via, for example, one or more signal lines or shared communication busses, and signals generated in controller 166 operate oven appliance 100 in response to user input via user input devices 136.

Input/Output ("I/O") signals may be routed between controller 166 and various operational components of oven appliance 100 such that operation of oven appliance 100 can be regulated by controller 166. In addition, controller 166 may also be communication with one or more sensors, such as temperature sensor 168 (FIG. 2), which may be used to measure temperature inside cooking chamber 120 and provide such measurements to the controller 166. Although temperature sensor 168 is illustrated at a top and rear of cooking chamber 120, it should be appreciated that other sensor types, positions, and configurations may be used according to alternative embodiments.

Controller 166 is a "processing device" or "controller" and may be embodied as described herein. Controller 166 may include a memory and one or more microprocessors, microcontrollers, application-specific integrated circuits (ASICS), CPUs or the like, such as general or special purpose microprocessors operable to execute programming instructions or micro-control code associated with operation of oven appliance 100, and controller 166 is not restricted necessarily to a single element. The memory may represent random access memory such as DRAM, or read only memory such as ROM, electrically erasable, programmable read only memory (EEPROM), or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Although aspects of the present subject matter are described herein in the context of a single oven appliance, it should be appreciated that oven appliance 100 is provided by way of example only. Other oven or range appliances having different configurations, different appearances, and/or different features may also be utilized with the present subject matter, e.g., double ovens, standalone cooktops, etc. Moreover, aspects of the present subject matter may be used in any other consumer or commercial appliance which includes a door, particularly those with viewing windows.

Figure 3:
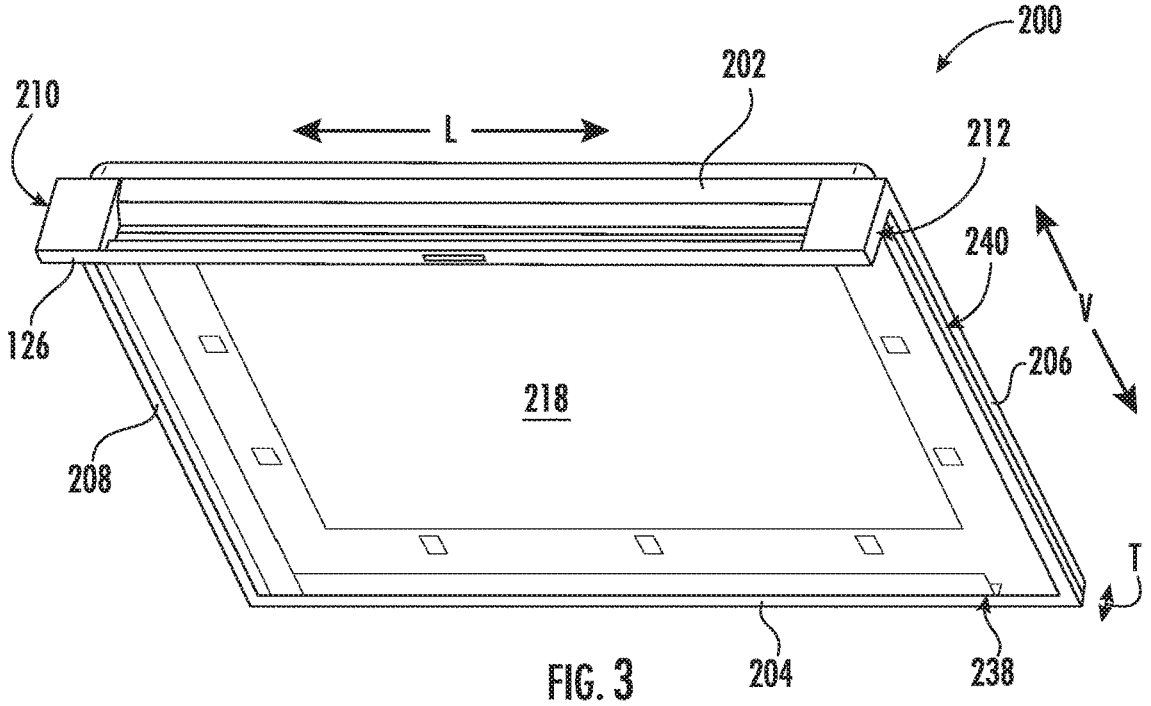
FIG. 3 is a perspective view of a door assembly that may be used with the exemplary oven appliance of FIG. 1 according to an exemplary embodiment of the present subject matter.
Figure 4:
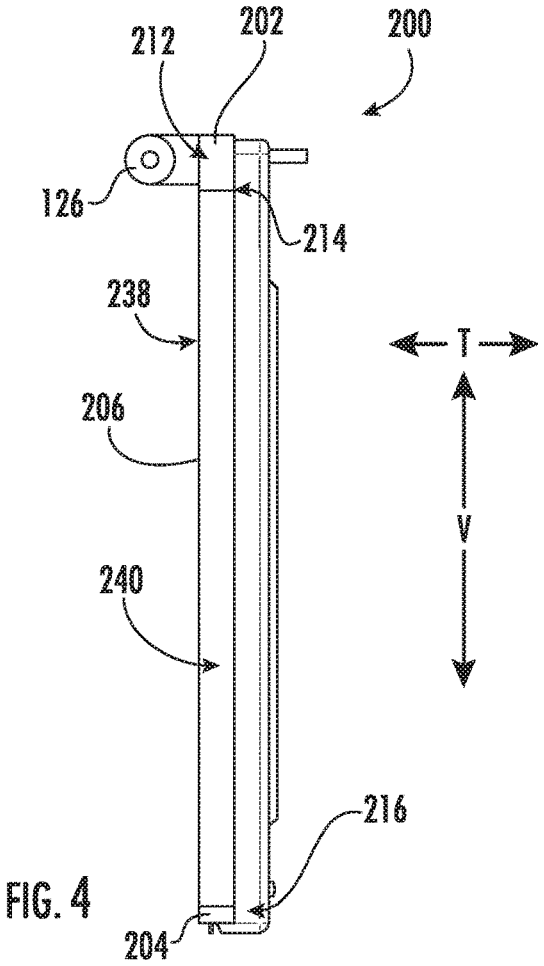
FIG. 4 is a side view of the exemplary door assembly of FIG. 3 according to an exemplary embodiment.

Referring now to FIGS. 3 and 4, a door assembly 200 which may be used with oven appliance 100 will be described according to exemplary embodiments of the present subject matter. Specifically, door assembly 200 may replace door 124 of oven appliance 100, or may be used as a door for any other suitable appliance. Although specific embodiments of door assembly 200 are described herein as being used with oven appliance 100, it should be appreciated that door assembly 200 may include different configurations and may be used with other appliances while remaining within the scope of the present subject matter.

As illustrated, door assembly 200 includes an outer door assembly (or a front panel) and an inner door assembly (or a rear panel) that are joined together. Each of the front panel and the rear panel may include one or more class window panes, insulating features, etc. However, as used herein the term "door assembly," generally refers to the outer door assembly, though aspects of the present subject matter may also be applied to the inner door assembly.

Also, it should be appreciated that due to the similarity between door 124 and door assembly 200, like reference numerals may be used to refer to the same or similar features. Furthermore, it should be appreciated that door assembly 200 is described as defining a vertical direction V, a lateral direction L, and a transverse direction T. According to exemplary embodiments, such directions correspond to the same directions of oven appliance 100 when door assembly 200 is in the closed position.

Figure 5:
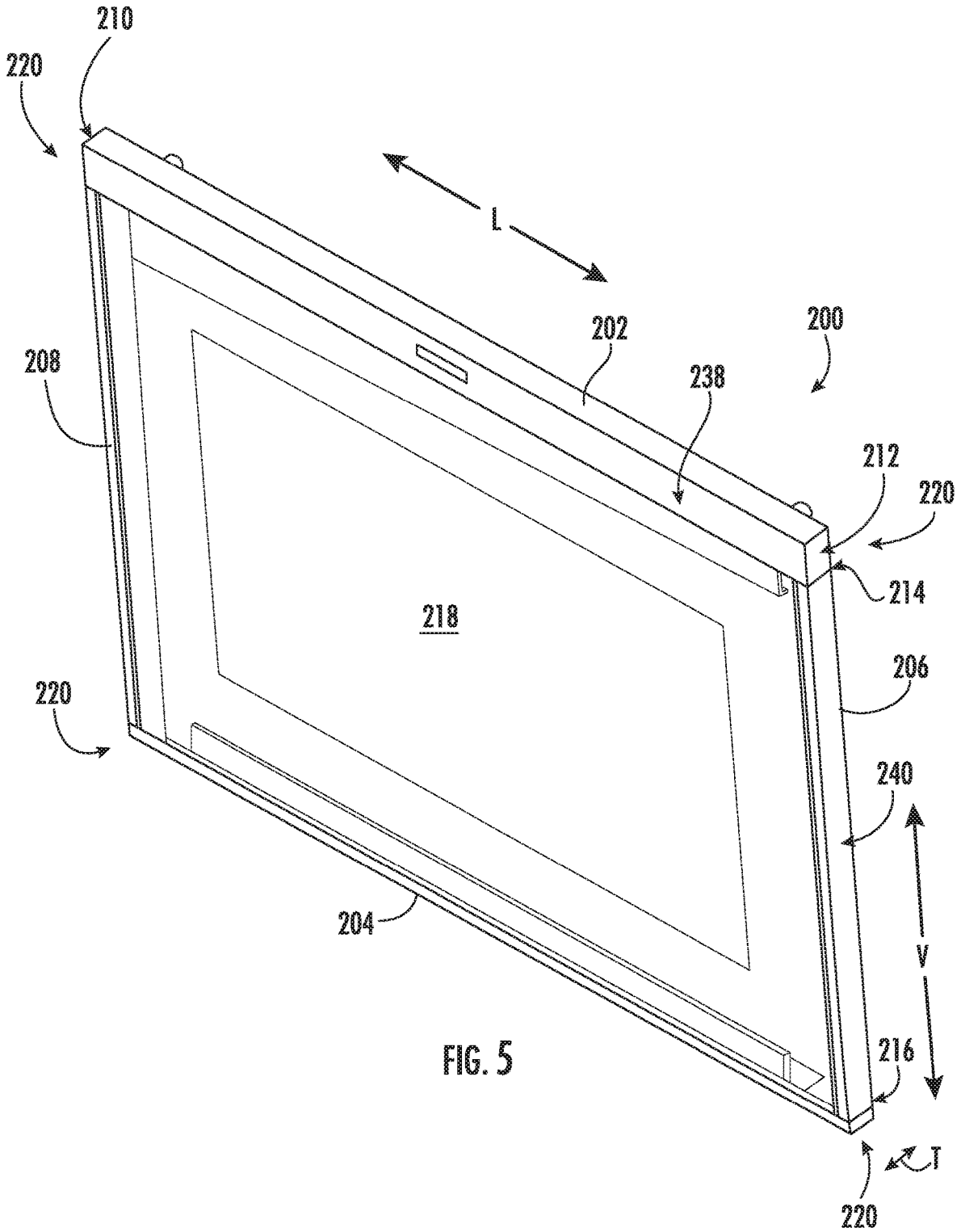
FIG. 5 is a perspective view of an outer door assembly of the exemplary door assembly of FIG. 3 according to an exemplary embodiment.

Referring now also generally to FIGS. 5 through 12, door assembly 200 will be described in more detail. For example, as best shown in FIG. 5, door assembly 200 may generally include a top frame member 202, a bottom frame member 204, a first side frame member 206, and a second side frame member 208. In general, top frame member 202 and bottom frame member 204 both extend between a left end 210 and a right end 212 along the lateral direction L. First side frame member 206 and second side frame member 208 extend from a top end 214 and a bottom end 216 along the vertical direction V.

As explained in more detail below, frame members 202-208 may be joined together to form a completed frame of door assembly 200. According to exemplary embodiments, a glass window pane 218 may be positioned within the completed frame as described in more detail below. Although these windows are referred to herein as glass panes, it should be appreciated that these transparent windows may be constructed of any suitably rigid and temperature resistant material, e.g., such as acrylic glass or Plexiglass.

As illustrated, frame members 202-208 are joined using a plurality of interlocking joints 220. As explained in detail below, interlocking joints 220 facilitate a quick and easy assembly of door assembly 200. Specifically, interlocking joints 220 are used to connect the various frame members 202-208 at the respective corners of door assembly 200 such that frame members 202-208 are mated and align in all three component directions (i.e., the V-L-T directions) and sit flush with each other for a clean appearance. Notably, interlocking joints 220 facilitate such assembly while compensating for manufacturing variations and tolerances. In addition, interlocking joints 220 and the described method of assembling door assembly 200 may eliminate the need for complex assembly fixtures, expensive and cumbersome adhesives, or additional brackets for positioning and securing windowpane 218. Furthermore, frame members 202-208 and windowpane 218 may be interchangeable such that one or all are constructed from different materials, may use different colors, or may be easily serviced and replaced.

Referring now specifically to FIGS. 6 through 12, the design and operation of interlocking joints 220 for joining two or more frame members will be described according to exemplary embodiments of the present subject matter. Specifically, to simplify explanation of aspects of the present subject matter, the discussion herein is primarily focused on the joining of top frame member 202 to first side frame member 206. However, it should be appreciated that the same or similar interlocking joints 220 may be used to couple other corners of door assembly 200.

Although the description herein refers to the joining of top frame member 202 to first side frame member 206, it should be appreciated that door assembly 200 may include any suitable number of frame members joined together using any suitable number of interlocking joints 220. For example, illustrations herein describe a door assembly 200 having four frame members 202-208. However, according to alternative embodiments, door assembly 200 may include only two frame members. For example, according such an embodiment, the bottom frame member could be U-shaped, thereby forming three sides of door assembly 200, and window pane 218 could slide into the U-shaped bottom frame member before a second, top member is joined to bottom frame member using interlocking joints 220 on the left and right sides of the top frame member. Other frame configurations are possible and within the scope of the present subject matter.

As shown in the figures, the first frame member, e.g., illustrated as top frame member 202 may generally define an alignment recess 230. Specifically, alignment recess 230 is illustrated as a void or slot defined in a bottom end 232 of top frame member 202 along the vertical direction V. Notably, alignment recess 230 may be defined by one or more locating surfaces of top frame member 202. Specifically, top frame member 202 may define a front locating surface 234 and a side locating surface 236. For reasons that will become more evident below, according to an exemplary embodiment, front locating surface 234 may generally extend substantially within a plane defined by the lateral direction L in vertical direction V. In addition, side locating surface 236 may generally extend substantially within a plane defined by the transverse direction T and the vertical direction V. It should be appreciated that as used herein, terms of approximation, such as "approximately," "substantially," or "about," refer to being within a ten percent margin of error.

According to exemplary embodiments, front locating surface 234 may be precisely positioned at a known distance from a front surface 238 of top frame member 202 along the transverse direction T. In addition, side locating surface 236 may be precisely positioned at a known distance from a side surface 240 of top frame member 202 along the lateral direction L. In this manner, as described in more detail below, when first side frame member 206 is positioned directly against these two locating services 234, 236, flush alignment between top frame member 202 and first side frame member 206 can be achieved quickly and accurately.

Referring still to FIGS. 6 through 12, the second frame member, e.g., first side frame member 206 that is joined to top frame member 202 may generally define a locking protrusion 250. Specifically, as illustrated, locking protrusion 250 extends from a top end face 252 of first side frame member 206. According to the illustrated embodiment, locking protrusion 250 generally defines a front seating face 254 that faces forward along the transverse direction T and a side seating face 256 that faces outward along the lateral direction L. In general, locking protrusion 250 is sized such that it may slide into or be received within the alignment recess 230.

More specifically, according to exemplary embodiments, locking protrusion 250 may be positioned within alignment recess 230 such that front seating face 254 is aligned with or engages front locating surface 234 of top frame member 202. Similarly, side seating face 256 of locking protrusion 250 may be aligned with or engaged against side locating surface 236. Notably, similar to the dimensions of alignment recess 230 and top frame member 202, front seating face 254 may be precisely positioned at a known distance from a front surface 238 of first side frame member 206 along the transverse direction T. In addition, side seating face 256 may be precisely positioned at a known distance from a side surface 240 of first side frame member 206 along the lateral direction L. It should be appreciated that as used herein, front surface 238 and side surface 240 may be used interchangeably to refer to the front or side surfaces, respectively, of any one of frame members 202-208 or door assembly 200 in general.

Notably, according to an exemplary embodiment, it is desirable that the angle between locating surfaces 234, 236 and the angle between seating faces 254, 256 be substantially similar. Specifically, as best illustrated FIG. 6, front seating face 254 and side seating face 256 may be separated by a face angle 258. According to an exemplary embodiment, face angle 258 is between about 60 and 120 degrees. According to still another embodiment, face angle 258 is approximately 90 degrees. According to an exemplary embodiment, a locating surface angle (not identified in the figures) is substantially identical to face angle 258.

Figure 6:
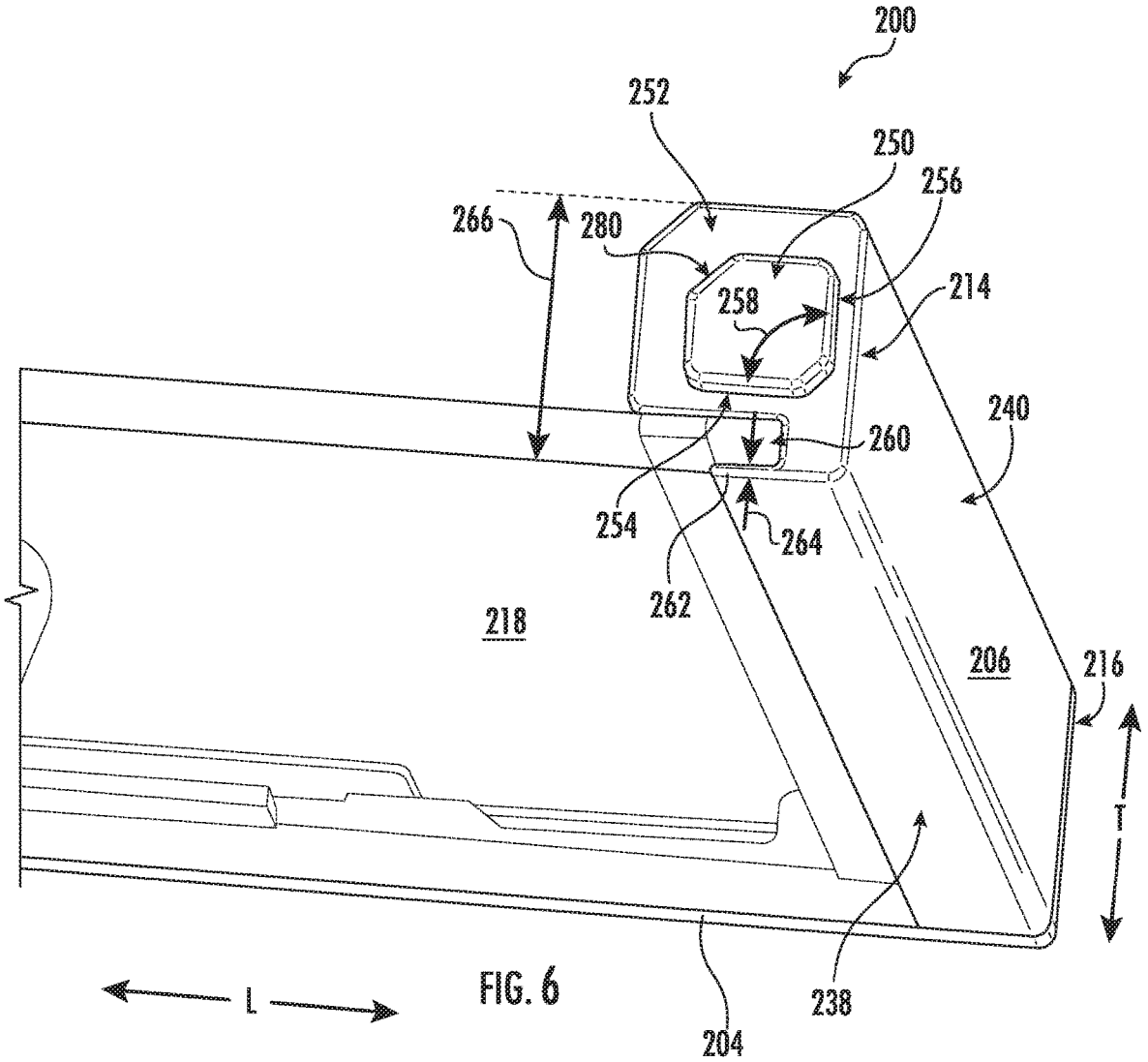
FIG. 6 is a perspective view of a first frame member and a second frame member of the exemplary outer door assembly of FIG. 5, with the first frame member removed to reveal a locking protrusion of the second frame member.
Figure 7:
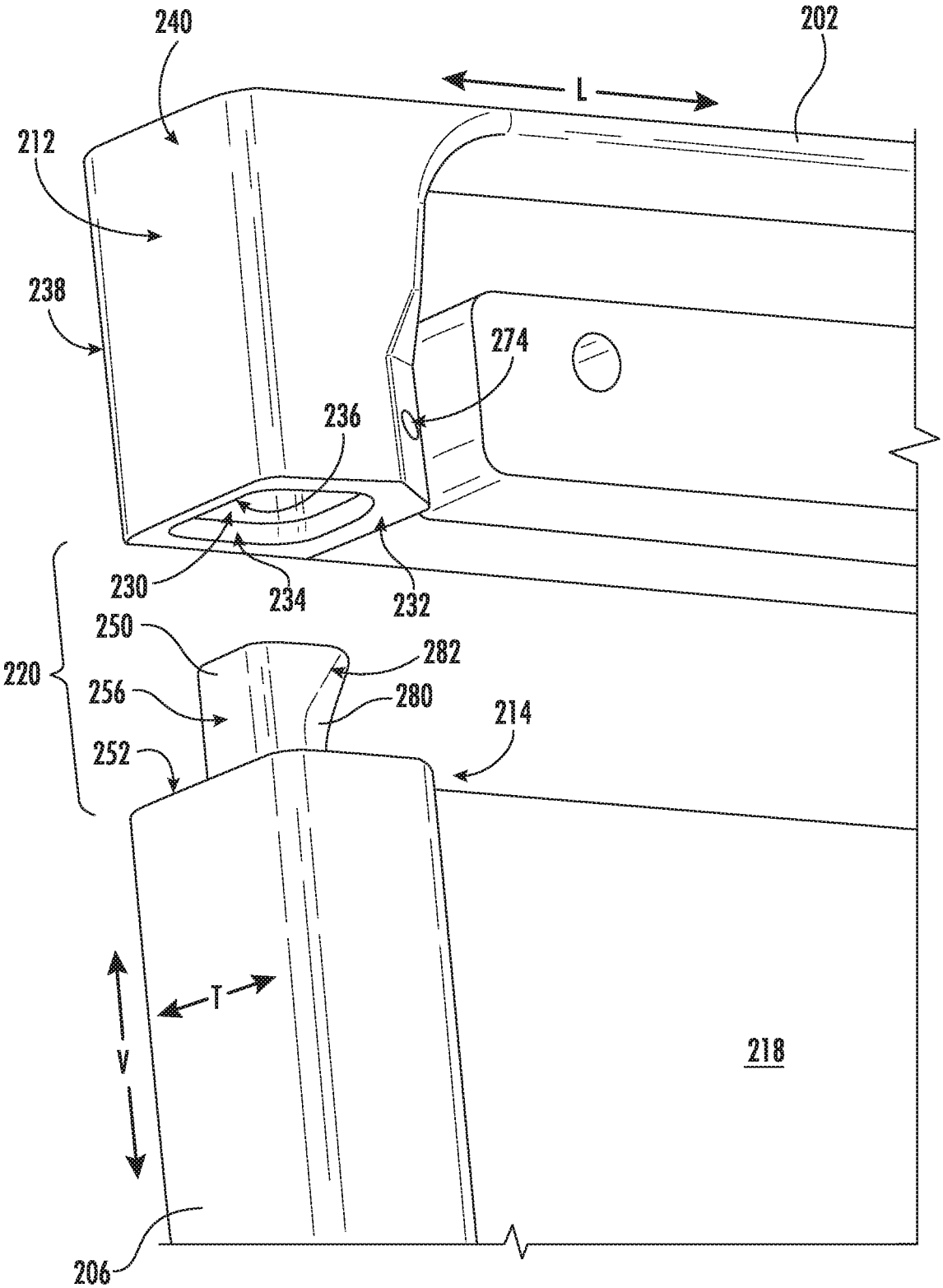
FIG. 7 is an exploded view of the exemplary first frame member and second frame member of FIG. 6 according to an exemplary embodiment.
Figure 8:
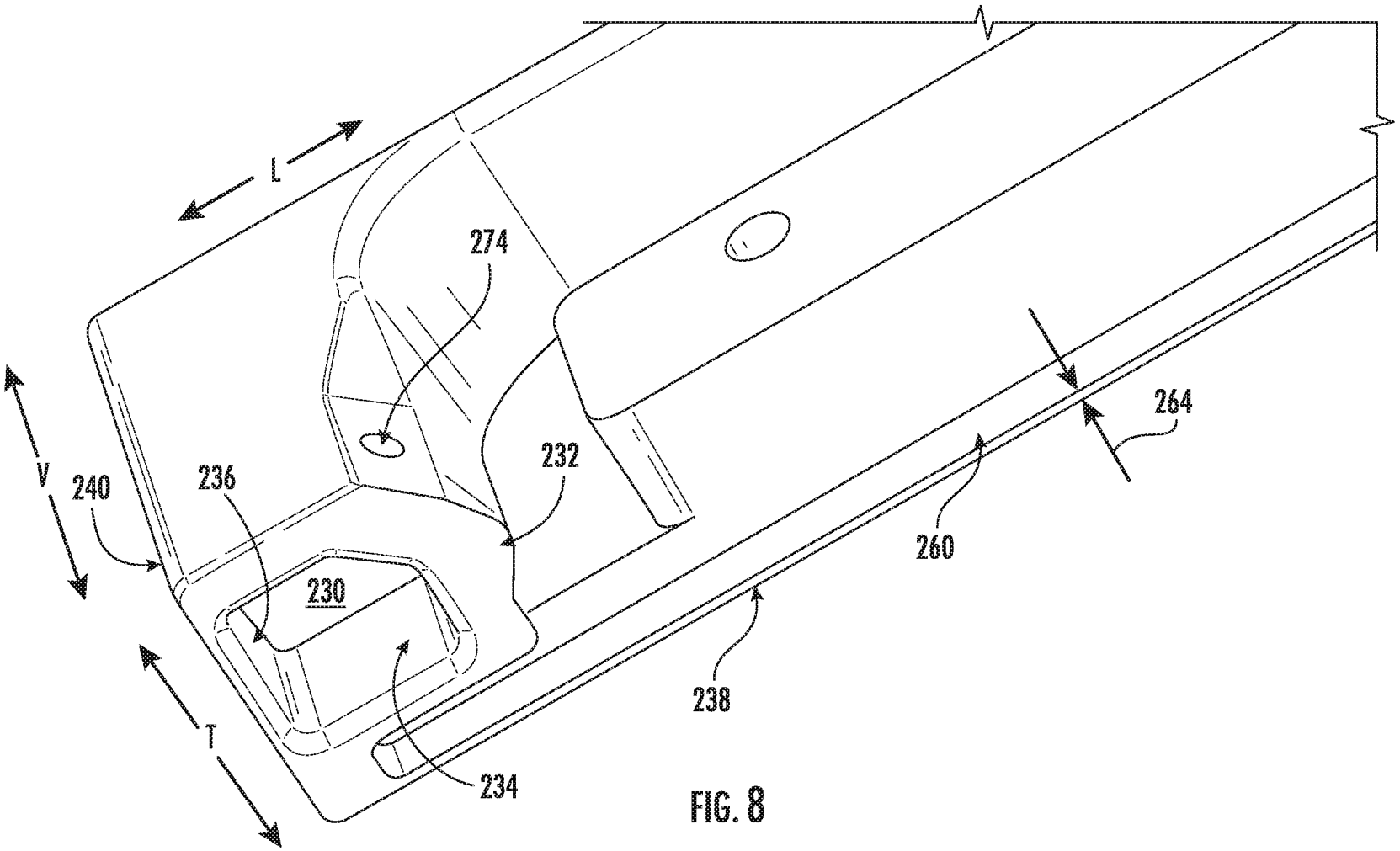
FIG. 8 is a bottom perspective view of the exemplary first frame member of FIG. 6 according to an exemplary embodiment.

As best shown in FIG. 6, door assembly 200 may include a perimeter groove for securely receiving window pane 218. Specifically, frame members 202-208 may each define an elongated groove 260 that extends around a perimeter of door assembly 200 and is sized for snuggly or securely receiving window pane 218. Notably, in order to position window pane 218 proximate front surface 238 of door assembly 200, groove 260 may be defined in part by a forward flange 262 defined on each of frame members 202-208. According to the illustrated embodiment, forward flange 262 defines a flange thickness 264 along the transverse direction T that is very small. For example, according to exemplary embodiments, flange thickness 264 may be less than 20%, less than 10%, less than 5%, or less, than a door assembly thickness 266 measured along the transverse direction T.

Door assembly 200 may further include features for urging first side frame member 206 into flush alignment with top frame member 202. In this regard, for example, door assembly 200 may include a mechanical fastener 270 that is configured for engaging first side frame member 206 to urge front seating face 254 into engagement with the front locating surface 234. In addition, or alternatively, mechanical fastener 270 may urge first side frame member 206 such that side seating face 256 engages or is seated against side locating surface 236. In this manner, when a user installs mechanical fastener 270, frame members 202-208 may be joined to form a complete frame with flush joints on both front surfaces 238 and side surfaces 240.

Figure 9:
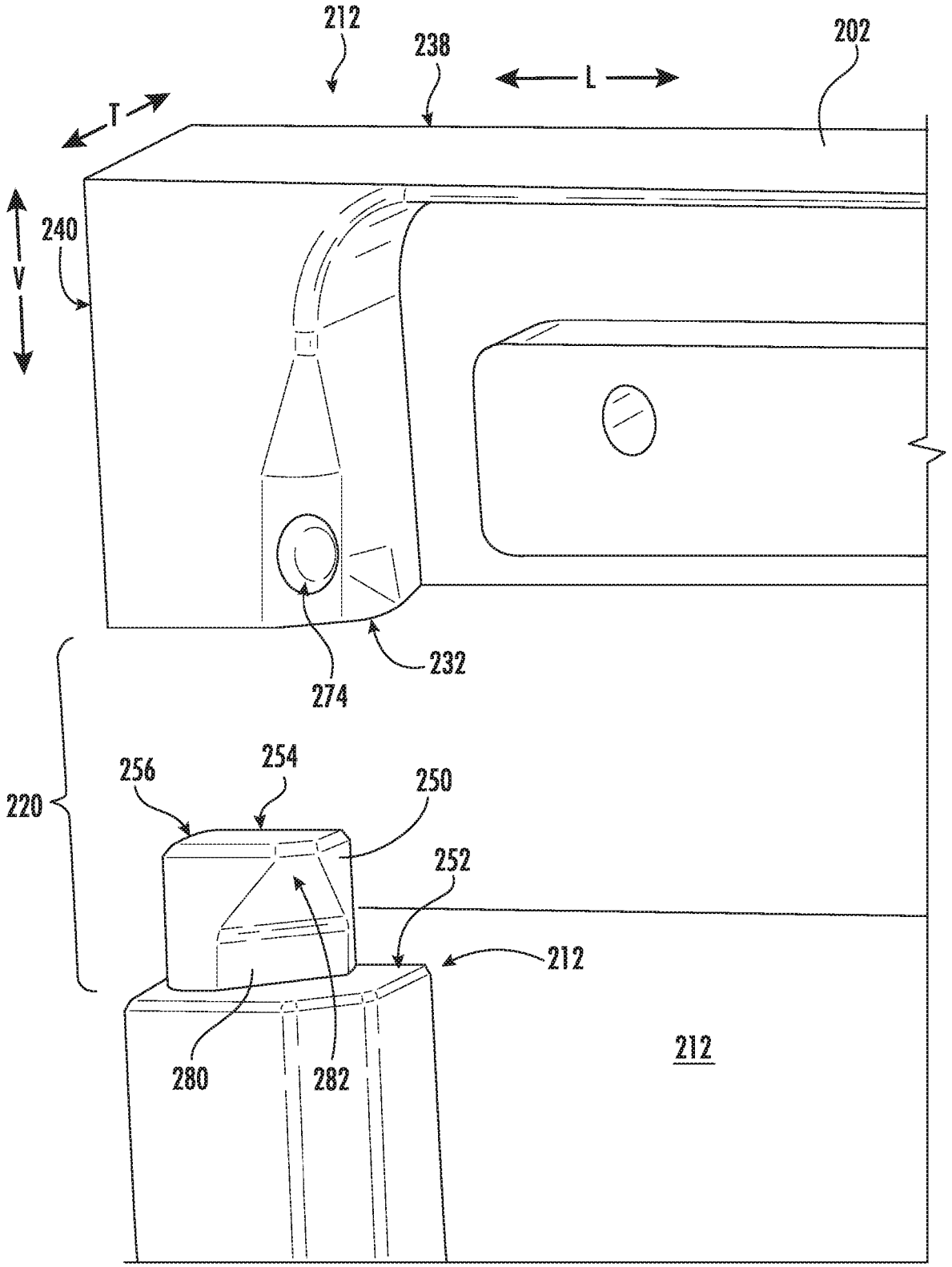
FIG. 9 is another exploded view of the exemplary first frame member and second frame member of FIG. 6 according to an exemplary embodiment.
Figure 10:
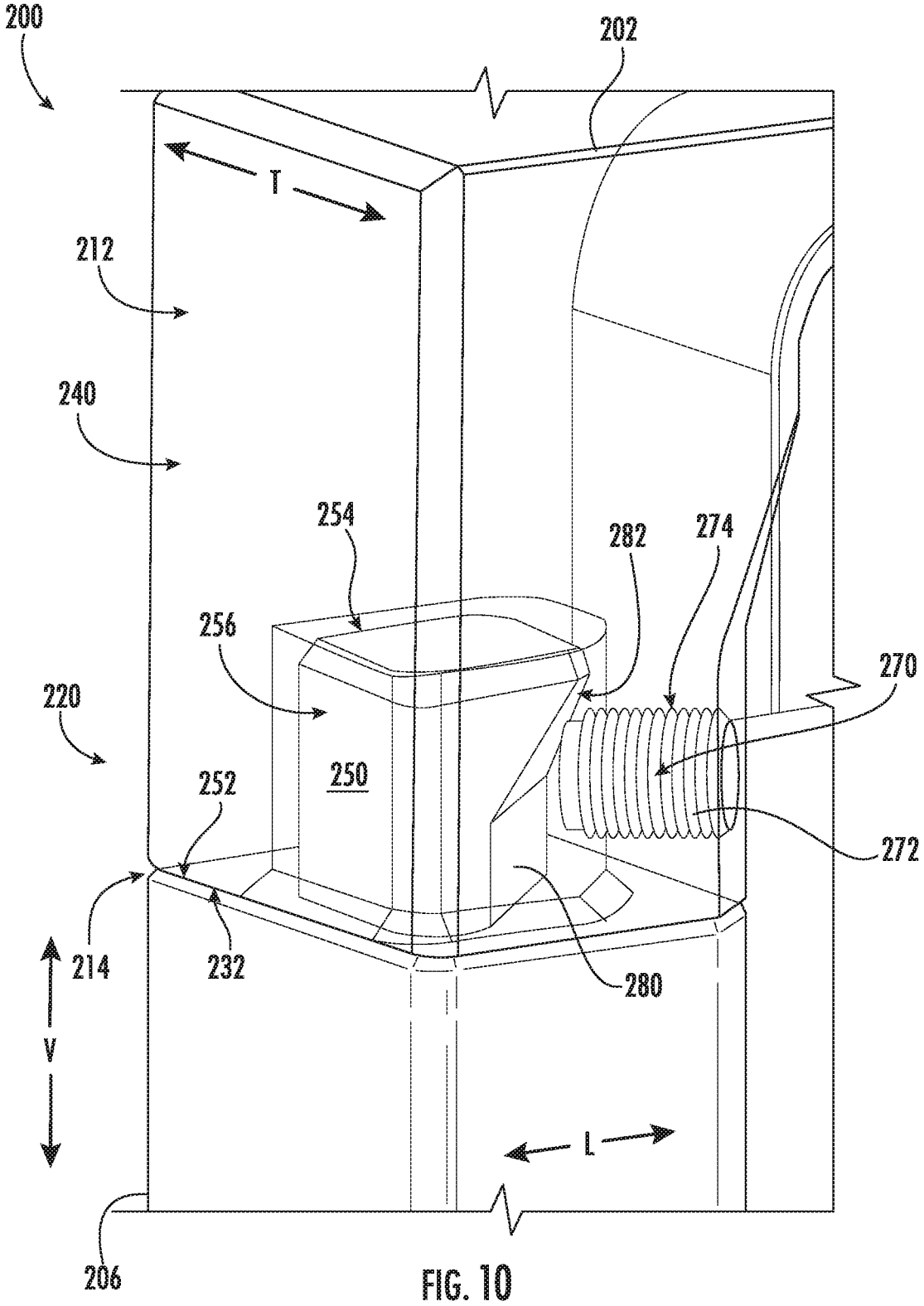
FIG. 10 is perspective view of the exemplary first frame member and second frame member of FIG. 6 with the first frame member illustrated in phantom for clarity.
Figure 11:
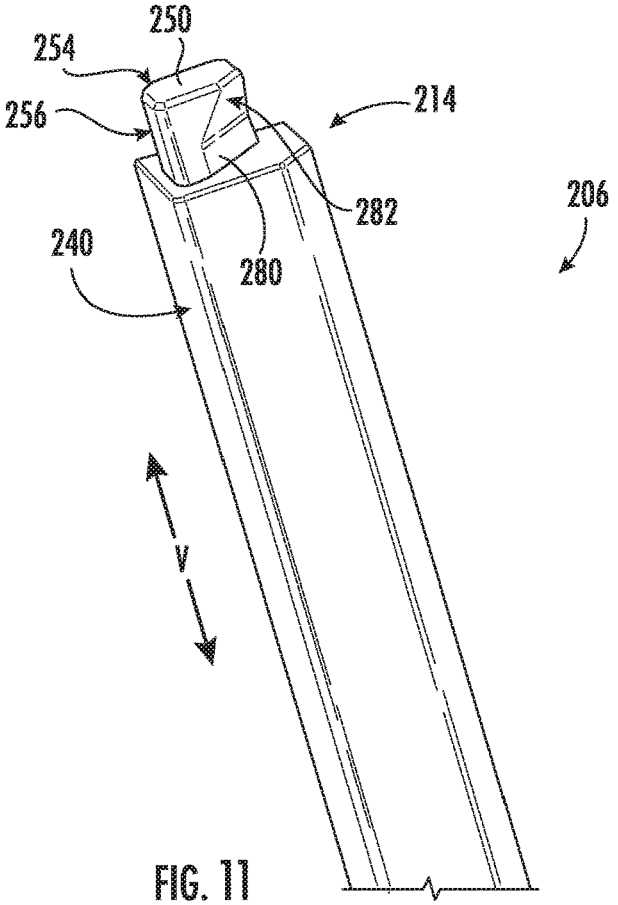
FIG. 11 is a perspective view of the exemplary second frame member of FIG. 6.

Referring now specifically to FIGS. 9 and 10, mechanical fastener 270 may be set screw 272 that is received within a fastener hole 274 defined within top frame member 202. In this manner, as set screw 272 is advanced through fastener hole 274, it pushes against locking protrusion 250 to establish firm contact between locating services 234, 236 and seating faces 254, 256.

Notably, in order to urge locking protrusion 250 along both the lateral direction L and the transverse direction T, it may be desirable that set screw 272 engages locking protrusion 250 at an angle relative to the lateral direction and the transverse direction T. In this regard, for example, locking protrusion 250 defines an interior surface 280 that faces toward fastener hole 274. According to the illustrated embodiment, interior surface 280 is angled at approximately 45 degrees relative to front seating face 254. In this manner, set screw 272 engages interior surface 280 to urge locking protrusion 250 directly toward a corner of door assembly 200, e.g., where front surface 238 and side surface 240 are joined. However, it should be appreciated that according to alternative embodiments, the angle of interior surface 280 may vary while remaining within the scope of the present subject matter. For example, if it is desirable only to align door assembly 200 along front surface 238, interior surface 280 may extend substantially within a plane defined by the vertical direction V and the lateral direction L. By contrast, if it is desirable and to align door assembly 200 along side surface 240, interior surface 280 may be oriented substantially parallel to a plane defined by the vertical direction V and the transverse direction T.

Figure 12:
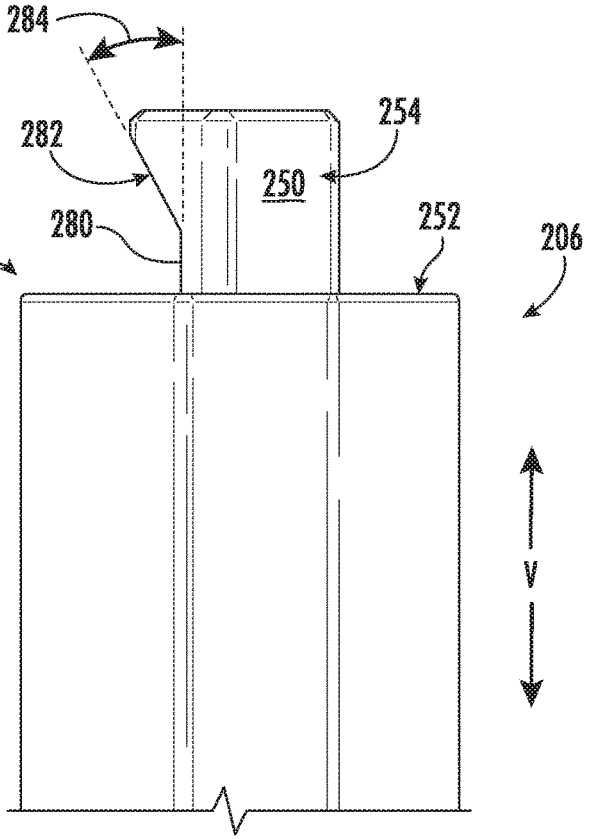
FIG. 12 is a close-up view of a locking protrusion of the exemplary second frame member of FIG. 6 according to an exemplary embodiment.

Notably, locking protrusion 250 may further define features for ensuring proper engagement of top frame member 202 and first side frame member 206 along the vertical direction V. In this regard, according to the illustrated embodiment, interior surface 280 defines a tapered surface 282 that is engaged by set screw 272 to draw locking protrusion 250 into alignment recess 230, i.e., urging first side frame member 206 upward and into top frame member 202. In this regard, as best illustrated in FIG. 12, tapered surface 282 may define a taper angle 284 measured relative to the vertical direction. According to an exemplary embodiment, tapered surface 282 may define taper angle 284 of between 40 and 80 degrees. According to the illustrated embodiment, taper angle 284 is approximately 60 degrees. Thus, as set screw 272 is advanced into fastener hole 274, first side frame member 206 is urged upward along the vertical direction V into top frame member 202, e.g., such that bottom end 232 of top frame member 202 engages top end face 252 of first side frame member 206.

As explained herein, door assembly 200 includes frame members 202-208 which are joined at their corners by interlocking joints 220. Interlocking joints 220 each include an alignment recess 230 for receiving a locking protrusion 250. Focusing for example on an upper left interlocking joint 220 of door assembly 200, when set screw 272 passes through top frame member 202 into alignment recess 230, it engages locking protrusion 250 to push first side frame member 206 into alignment along front surface 238 of door assembly 200 and into alignment along side surface 240 of door assembly 200. In addition, top frame member 202 and first side frame 206 are drawn together in firm engagement such that little or no seam is visible between the two. The resulting door assembly 200 is easy to assemble, is cost-effective, and provides a desirable appearance for the consumer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door assembly for providing selective access to a chamber of an appliance, the door assembly comprising:

a first frame member defining an alignment recess, the alignment recess defined at least in part by a front locating surface and a side locating surface;

a second frame member defining a locking protrusion having a front seating face and a side seating face, wherein the front seating face and the side seating face are separated by a face angle measured within a horizontal plane, the face angle being between about 60 and 120 degrees, the locking protrusion configured for receipt within the alignment recess; and a mechanical fastener engaging the second frame member to urge the front seating face and the side seating face of the second frame member into engagement with the front locating surface and the side locating surface, respectively, of the first frame member.

2. The door assembly of claim 1, wherein the first frame member further defines a first groove and the second frame member further defines a second groove, the door assembly further comprising:

a window pane secured within the first groove and the second groove.

3. The door assembly of claim 2, wherein the first groove is defined at least in part by a first forward flange positioned at a front surface of the first frame member, the second groove is defined at least in part by a second forward flange positioned at a front surface of the second frame member, and wherein the first forward flange and the second forward flange each define a flange thickness measured along a transverse direction that is less than 5% of a door assembly thickness measured along the transverse direction.

4. The door assembly of claim 1, wherein a front surface of the first frame member sits flush with a front surface of the second frame member when the front seating face engages the front locating surface.

5. The door assembly of claim 4, wherein the mechanical fastener further urges the side seating face into engagement with the side locating surface such that a side surface of the first frame member sits flush with a side surface of the second frame member.

6. The door assembly of claim 1, wherein the face angle is approximately 90 degrees.

7. The door assembly of claim 1, wherein the mechanical fastener is a set screw.

8. The door assembly of claim 1, wherein the first frame member defines a fastener hole configured for receiving the mechanical fastener to urge the locking protrusion toward a front surface and a side surface of the first frame member.

9. The door assembly of claim 8, wherein the locking protrusion defines an interior surface facing toward the fastener hole, wherein the interior surface is angled at approximately 45 degrees relative to the front seating face.

10. The door assembly of claim 9, wherein the interior surface defines a tapered surface that is engaged by the mechanical fastener to draw the locking protrusion into the alignment recess and urge the second frame member toward the first frame member.

11. The door assembly of claim 10, wherein the tapered surface defines a taper angle measured relative to a vertical direction, the taper angle being between about 30 and 60 degrees.

12. The door assembly of claim 1, wherein the alignment recess is a first alignment recess, the first frame member defining a second alignment recess at an opposite end of the first frame member, wherein the locking protrusion is a first locking protrusion, the second frame member defining a second locking protrusion at an opposite end of the second frame member, and wherein the second locking protrusion is received within the second alignment recess to join the first frame member and the second frame member to form a completed frame.

13. The door assembly of claim 1, further comprising:

a third frame member; and a fourth frame member, and wherein the first frame member, the second frame member, the third frame member, the fourth frame member are joined to form a completed frame using a plurality of interlocking joints, each of the plurality of interlocking joints comprising an alignment recess and a locking protrusion.

14. The door assembly of claim 1, wherein the first frame member and the second frame member are constructed of different materials or have different colors.

15. An oven appliance defining a vertical, a lateral, and a transverse direction, the oven appliance comprising:

a cabinet;

a cooking chamber positioned within the cabinet;

a door assembly rotatably mounted to the cabinet for providing selective access to the cooking chamber, the door assembly comprising a first frame member defining an alignment recess, the alignment recess defined at least in part by a front locating surface and a side locating surface;

a second frame member defining a locking protrusion having a front seating face and a side seating face, wherein the front seating face and the side seating face are separated by a face angle measured within a horizontal plane, the face angle being between about 60 and 120 degrees, the locking protrusion configured for receipt within the alignment recess; and a mechanical fastener engaging the second frame member to urge the front seating face and the side seating face of the second frame member into engagement with the front locating surface and the side locating surface, respectively, of the first frame member.

16. The oven appliance of claim 15, wherein the mechanical fastener further urges the side seating face into engagement with the side locating surface such that a side surface of the first frame member sits flush with a side surface of the second frame member.

17. The oven appliance of claim 15, wherein the first frame member defines a fastener hole configured for receiving the mechanical fastener to urge the locking protrusion toward a front surface and a side surface of the first frame member.

18. The oven appliance of claim 17, wherein the locking protrusion defines an interior surface facing toward the fastener hole, wherein the interior surface is angled at approximately 45 degrees relative to the front seating face, and wherein the interior surface defines a tapered surface that is engaged by the mechanical fastener to draw the locking protrusion into the alignment recess and urge the second frame member toward the first frame member.

19. The oven appliance of claim 15, wherein the first frame member and the second frame member are constructed of different materials or have different colors.

* * * * *